United States Patent [19]

Yokomori

[11] 4,034,525

[45] July 12, 1977

[54] STAIR STRUCTURE

[76] Inventor: Seibun Yokomori, c/o Kabushiki Kaisha Yokomori Seisakusho, 29-2, Hatagaya 1-chome, Shibuya, Tokyo, Japan

[21] Appl. No.: 614,027

[22] Filed: Sept. 16, 1975

[30] Foreign Application Priority Data

Jan. 16, 1975 Japan ..... 50-7933[U]
Apr. 18, 1975 Japan ..... 50-53775[U]

[51] Int. Cl.[2] ..... E04F 11/00
[52] U.S. Cl. ..... 52/188; 52/191
[58] Field of Search ..... 52/177, 179, 181, 182, 52/188, 191; 228/165

[56] References Cited

U.S. PATENT DOCUMENTS

| | | | |
|---|---|---|---|
| 348,782 | 9/1886 | Sawyer | 52/177 |
| 1,452,467 | 4/1923 | Lambert | 52/191 |
| 1,503,773 | 8/1924 | Stanwood | 52/179 |
| 2,216,250 | 10/1940 | Nelson | 52/182 |
| 3,499,254 | 3/1970 | Jefferys | 52/182 |
| 3,770,393 | 11/1973 | Hoy | 228/165 |

FOREIGN PATENT DOCUMENTS

| | | | |
|---|---|---|---|
| 570,621 | 7/1945 | United Kingdom | 52/182 |

*Primary Examiner*—Price C. Faw, Jr.
*Assistant Examiner*—Carl D. Friedman
*Attorney, Agent, or Firm*—Wenderoth, Lind & Ponack

[57] ABSTRACT

The construction of step members for building a stairway structure is disclosed. All individual step members have a like construction; each comprises a first vertically extending plate-like element provided at one end with a first rolled portion and a second horizontally extending plate-like element provided at one end with a second rolled portion. The first and second rolled portions form openings which are substantially the same, and fastening means are passed through these openings to connect the step members to parallel stringers.

11 Claims, 9 Drawing Figures

STAIR STRUCTURE

BACKGROUND OF THE INVENTION

This invention relates to a stair structure, and more particularly to a structure of a flight of stair steps which include separate structural members for easy assembly and construction.

According to conventional stair structures of iron or steel framed construction or other known stair structures installed for usual or permanent use, all of which are installed inside or outside the building or house, the separate structural members of specified dimensions are welded at the location where the stairs are assembled and built into a finished stair structure, or else all the individual step members are previously completed at the manufacturing plant and are assembled at their location into a finished stair structure. When a stair structure is completed by welding all its separate members, there are disadvantages which include the increased amount of work for welding the members at their location, the difficulty of securing the necessary manpower to engage in the welding work, the unreliable welded spots of the assembled members, and the extremely limited acceptability of using fire in some surroundings where a stair structure is installed. These disadvantages limit the time and area for building or installing a stair structure. When a stair structure is built by assembling all the previously completed step members at their final location, the use of cranes or other large-scale machines are involved. In this case, there are also limitations to installing a stair structure inside a completed building, since it is difficult or impossible to move the individual step members and other structural members into the building which has been completed. This means that the time at which the installation work should begin is extremely limited. Other disadvantages include the limitations include working area and manpower.

SUMMARY OF THE INVENTION

With the above disadvantages in view, one object of the present invention is therefore to provide a stair structure which is easily assembled and constructed.

It is another object of the present invention to provide a stair structure which can be installed with the minimum of the structural strains which usually arise with the conventional stair structures completed by welding all the members during assembly.

It is still another object of the present invention to provide a stair structure which can be installed at any desired time, regardless of the progress of a building construction, and at any location or working area inside or outside the building.

It is a further object of the present invention to provide a stair structure which can be installed with a minimum of labor.

As is clear from the above objects of the invention, the stair structure according to the invention essentially comprises two separate parts, one of which includes two parallel stringers, and the other includes separate stair step members. Those parts may previously be assembled at the manufacturing plant, but may also be assembled at the location where a stair structure is installed. It should be noted in the latter case that all structural members can be moved into the completed bulding and can be assembled into a finished stair structure there since all members are separately manufactured and easily assembled at their final location. There is no need or appreciably less need to weld the members for assembly, and this eliminates the problem of strains which may usually arise in the welded members. It should also be noted that the stair structure is of a simple construction and is, therefore, economical, since it can be built from a relatively small amount of material.

Other objects and advantages of the invention will become apparent from the following specification and the accompanying drawings.

DESCRIPTION OF THE PREFERRED EMBODIMENTS

Figure 1:
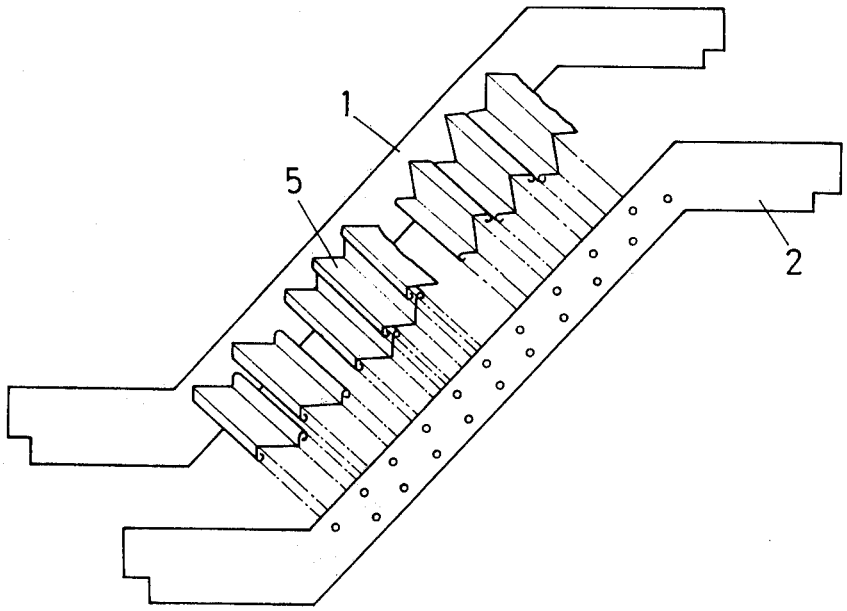
FIG. 1 is a perspective view of a stair structure provided according to the invention.
Figure 2:
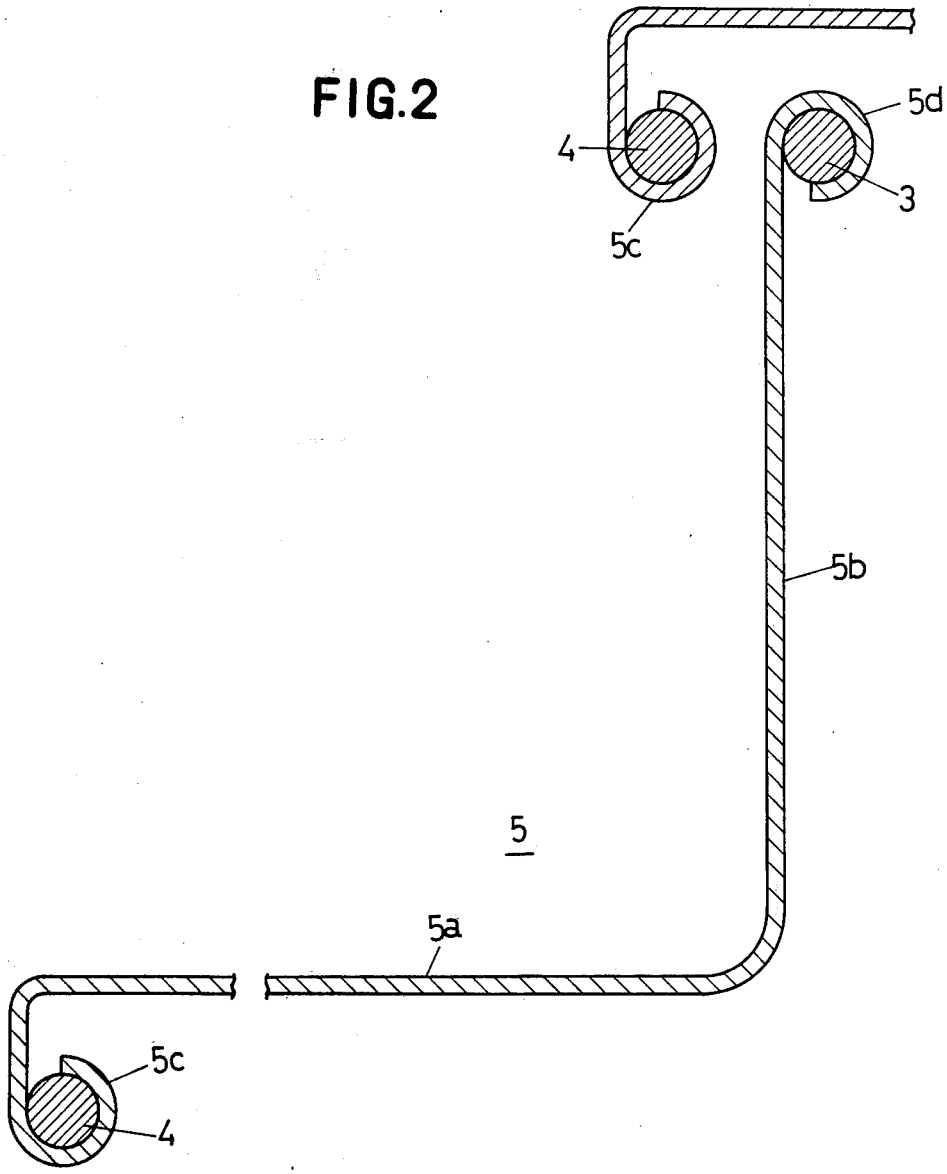
FIG. 2 is a partly enlarged sectional view of a first preferred embodiment of the invention, showing a stair step member which includes a horizontal tread and a vertical riser.

The invention will further be illustrated by way of several preferred embodiments with reference to the accompanying drawings, in which:

Referring first to FIG. 1, two parallel stringers 1 and 2 are arranged at regularly-spaced intervals, and are provided with a series of regularly-spaced holes on the side walls thereof into which mounting bolts 3 and 4 are inserted. As particularly shown in FIG. 2, a stair step member 5 includes a horizontal part or tread 5*a* and a vertical part or riser 5*b*. The lower end portion of said tread 5*a* has a wound portion 5*c* through which a mounting bolt 4 is inserted, and the upper end portion of said riser 5*b* has a wound portion 5*d* through which a mounting bolt 3 is inserted. The stair step member 5 is thus supported and fastened by the mounting bolts 3 and 4 to the stringers 1 and 2. All other step members are assembled literally step by step in the same manner.

Figure 3:
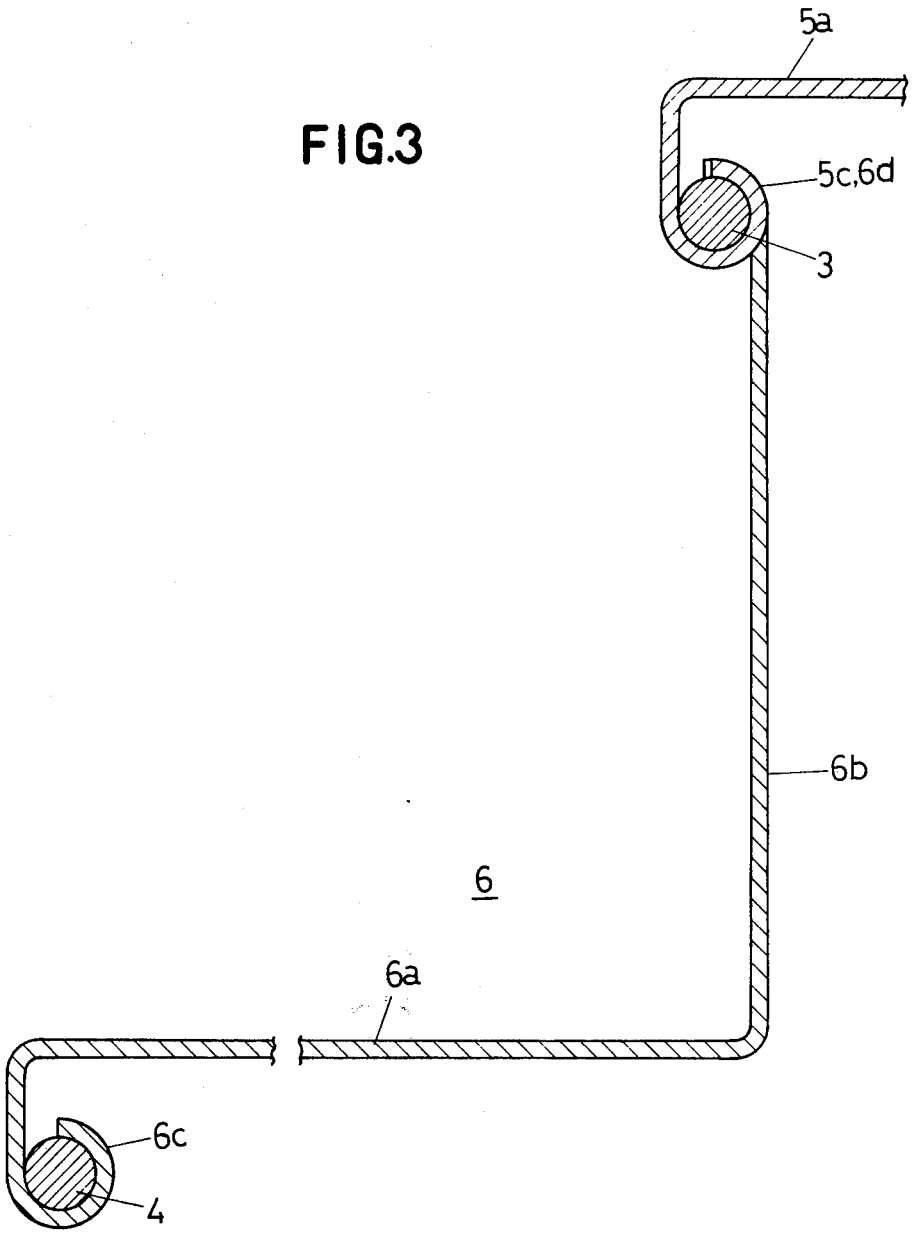
FIG. 3 is a partly enlarged sectional view of a second preferred embodiment of the invention, showing two adjacent stair step members supported by the same mounting bolt.

In a second preferred embodiment of the invention shown in FIG. 3, two higher and lower level step members 5 and 6 are assembled together such that the upper wound portion 6*d* of the lower-level step member 6 receives and is supported by the same mounting bolt 3 through the lower wound portion 5*c* of the higher-level step member 5.

Figure 4:
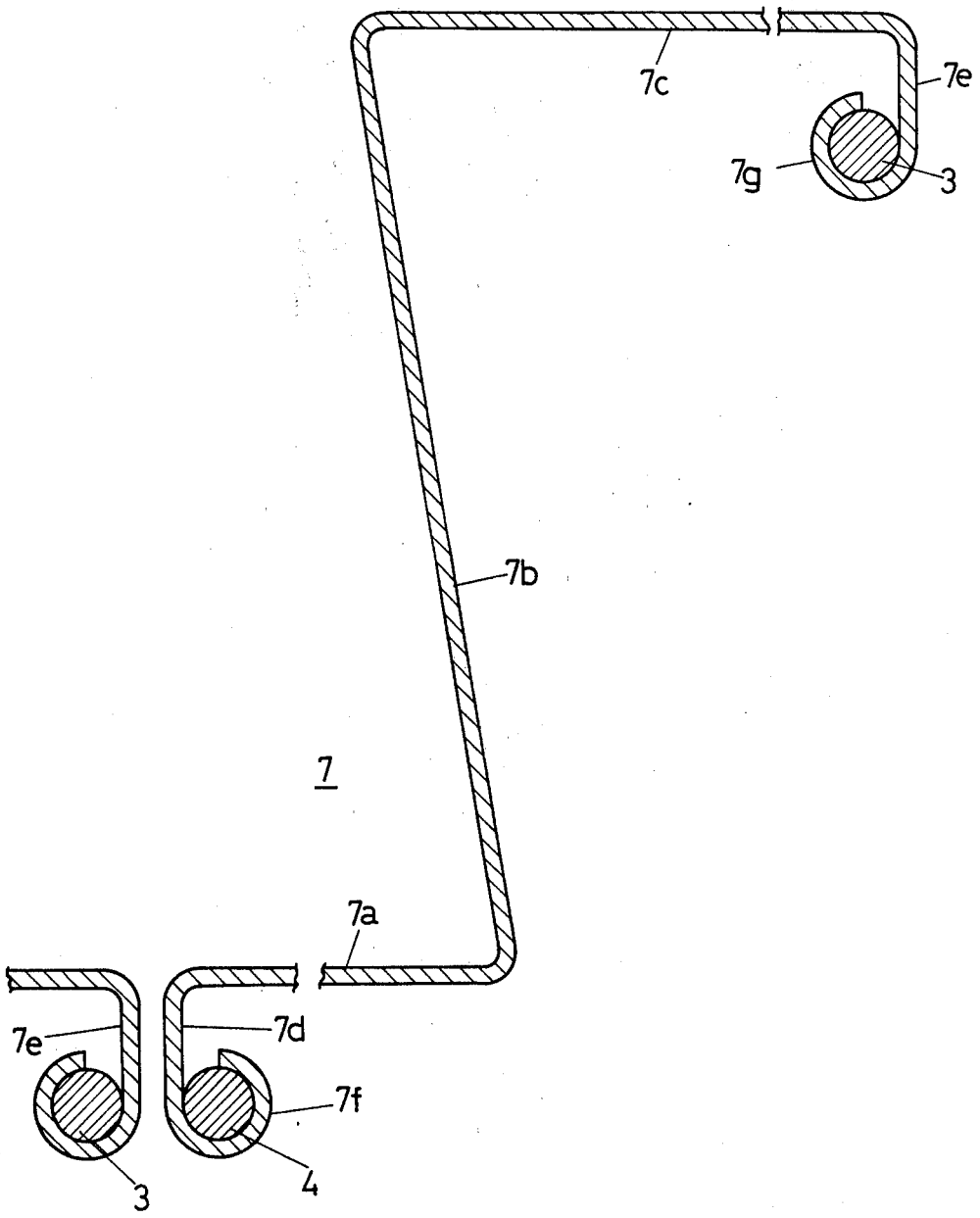
FIG. 4 is a partly enlarged sectional view of a third preferred embodiment of the invention, showing a stair step member which includes a riser and two lower and higher level treads, each of said two treads having a run of step of substantially one half smaller length than the height of said riser.

FIG. 4 indicates a third preferred embodiment of the invention, in which a two-level step member 7 is shown and includes a vertical riser 7*b* and lower and higher level horizontal treads 7*a* and 7*c*, each of said treads 7*a* and 7*c* having a step of a substantially one-half smaller length than the height of said riser 7*b*. The lower-level tread 7*a* has a downwardly bent portion 7*d* whose end is in the form of a wound portion 7*f* through which a mounting bolt 4 is passed, and the higher-level tread 7*c* also has a downwardly bent portion 7*e* whose end has the form of a wound portion 7*g* through which a mounting bolt 3 is inserted. As noted above, the step member 7 can provide greater rigidity or strength since it is generally constructed in the form as shown.

Figure 5:
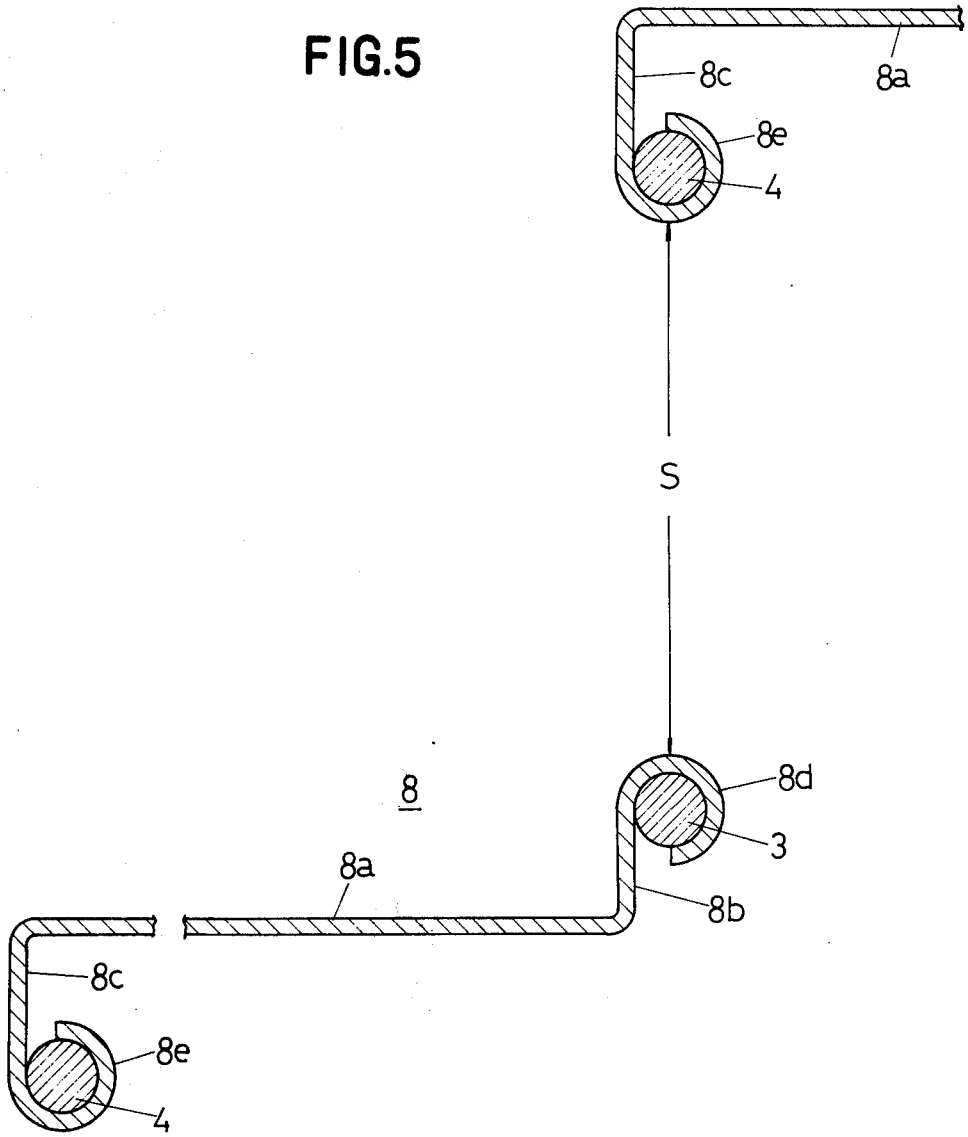
FIG. 5 is a partly enlarged sectional view of a fourth preferred embodiment of the invention, showing a stair step member whose riser is of a smaller height.

In a fourth preferred embodiment shown in FIG. 5, a stair step member 8 includes a horizontal part or tread 8*a* which has on one side thereof an upwardly bent portion 8*b* whose end is in the form of an upper wound portion 8*d* through which a mounting bolt 3 is passed, and on the other side thereof, is a downwardly bent portion 8*c* whose end is in the form of a lower wound portion 8*e* through which a mounting bolt 4 is passed. As seen from FIG. 5, the upper wound portion 8*d* of the lower-level step member is spaced a distance S from the lower wound portion 8*e* of the higher-level step member, and the portion 8*b* acts as a riser of a smaller height.

Figure 6:
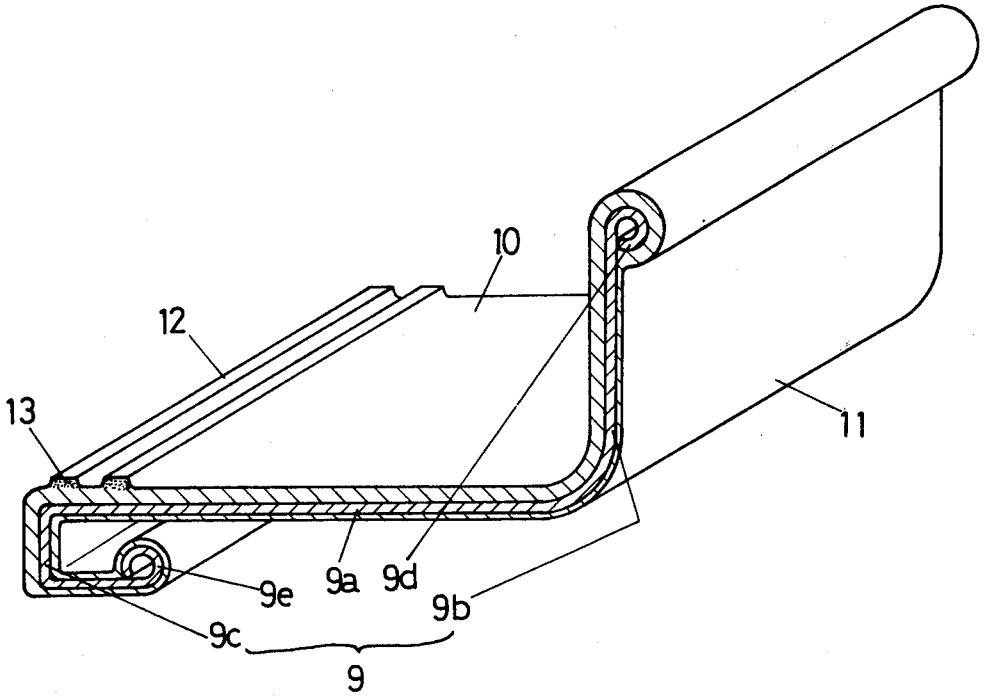
FIG. 6 is an enlarged perspective view of a fifth preferred embodiment of the invention, showing a stair step member wholly coated with two upper and lower layers of synthetic resin material.
Figure 7:
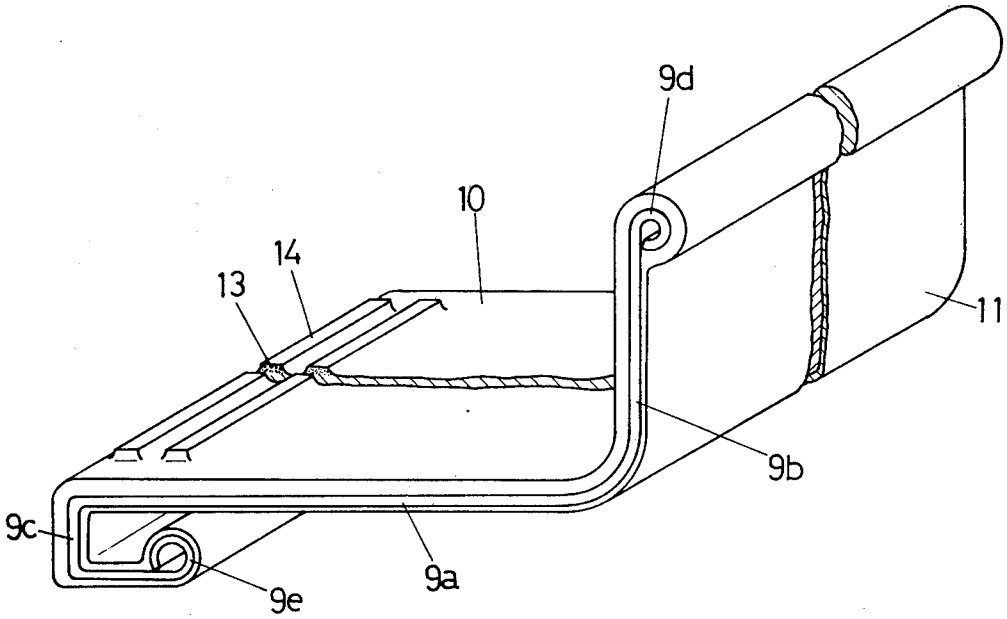
FIG. 7 is also an enlarged perspective view showing the stair step member cut centrally therethrough showing the internal construction thereof.

In accordance with a fifth preferred embodiment of the invention, a stair step member is wholly coated with synthetic resin material. As particularly shown in FIG. 6, each stair step member consists of three layers 9, 10 and 11 of materials, the innermost layer 9 of which is of metallic material and is wholly coated with the other upper and lower layers 10 and 11 of synthetic resin material such as polyurethane. The step member includes a horizontal tread 9*a*, a vertical riser 9*b* which extends upwardly from the right-hand side of the tread 9*a*, and a downwardly bent portion 9*c* provided on the left-hand side of the tread 9*a*, the end of said riser 9*b* having a wound portion 9*d* for insertion of a mounting bolt therethrough and the end of said downwardly bent portion 9*c* having a wound portion 9*e* through which a mounting bolt is passed. As shown in FIG. 6, two parallel elevated strips 12 are provided across the surface of the tread 9*a* on the left-hand side thereof. The elevated strips 12 can serve to prevent stumbling or misstepping and are internally made of granular material 13 of wear-resistant character. In FIG. 7, two parallel elevated strips 14 are shown which are of a smaller length than those shown in FIG. 6. In FIGS. 6 and 7, the stumbling or misstepping preventing means is provided in the form of elevated strips 12 or 14, but may be formed by a great number of rounded projections or bosses spaced at regular intervals. The shape or form of the stumbling preventing means is arbitrary.

In the embodiments described above, polyurethane material is shown, for example, which covers the upper and under faces of the step member, but this material may be replaced by other materials such as natural or synthetic resin material. In other words, resins or synthetic rubber of desired strength which can resist all weathers, medicine or chemical effects and/or wears may serve the objects of the invention. The wear-resistant granular material 13 referred to earlier consists of granular material of great strength and of a nature which enables a great amount of the material to be packed closely within the resin material. Such material includes metal powder (simple metal or alloy powder), mineral powder or artificial powder (grinding grains usually used as abrasives).

Figure 8:
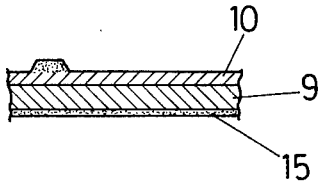
FIG. 8 is a partly enlarged sectional view of a sixth preferred embodiment of the invention, showing a stair step member whose underside is coated with a layer of fireproof material.

In accordance with a futher preferred embodiment of the invention shown in FIG. 8, the innermost part 9 of the step member has the upper coating of polyurethane material 10 as in the earlier embodiment of FIGS. 6 and 7, and may preferably be coated with a lower layer of micro balloon 15 by means of synthetic adhesive material. In this manner, it is possible to decrease the manufacturing costs appreciably; it is also better to protect the step member from fire.

Figure 9:
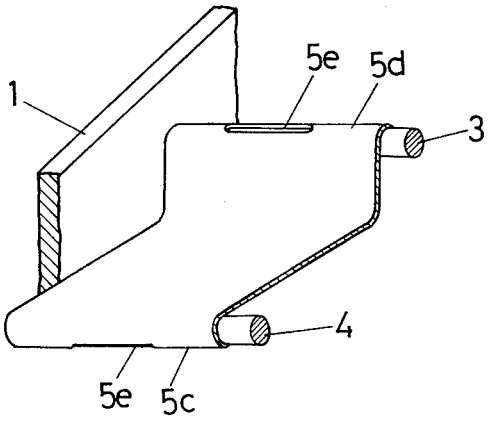
FIG. 9 is a partly enlarged perspective view of a seventh preferred embodiment of the invention, showing a stair step member solidly fastened by welding means to the mounting bolts.

In the embodiments illustrated heretofore, it is shown that the step member is solidly fastened to the stringers 1 and 2 by passing the mounting bolts 3 and 4 from any one of the stringers 1 or 2 and through the wound portions 5*c* and 5*d*, for example, of the step member to the other stringer. In a still further preferred embodiment shown in FIG. 9, however, the wound portions 5*c* and 5*d* are provided with a rectangular cutout 5*e*, 5*e* through which a welding process is effected for solidly fastening the portions 5*c* and 5*d* to the mounting bolts 3 and 4 which pass through the portions 5*c* and 5*d*.

As is clearly understood from the various embodiments described above, all assembly members including a series of separate stair step members and stringers can be moved to any desired location and particularly to a relatively small space or area inside the building, and can very easily be assembled and built within a small area of the location where a stair structure is installed. One advantage of the invention is the easiness with which all stair step members can be installed step by step and solidly fastened to the stringers by means of the mounting bolts. Another advantage is that all assembly members can be built into a solidly assembled stair structure without any welding means or by welding the very limited area of the members. A still further advantage is that the installation work can be carried out at any time and at any location without limitations. In the embodiments in which all stair step members have coatings of the upper and lower layers of resin material as shown in FIGS. 6 through 9, it is possible to protect the step members from rusting as long as they are in service. This provides improved maintenance service and durability of the whole stair structure, and provides a noise-free stair structure.

Although the invention has been illustrated with reference to the several preferred embodiments thereof, it should be understood that various changes and modifications may be made without departing from the spirit and scope of the invention.

What is claimed is:

1. A stairway structure comprising:

two parallel stringers spaced from each other, said stringers having a plurality of regularly-spaced holes therethrough;

a plurality of adjacent step member means for providing a stairway surface fitted between said stringers and having openings therethrough aligned with said regularly-spaced holes in said stringers, each step means comprised of:

a vertical plate-like member having a first rolled portion across one end thereof, said rolled portion forming a first opening therethrough, a first horizontal plate-like member having a second rolled portion at one end thereof, said second rolled portion forming a second opening therethrough, said horizontal plate-like member being integrally formed with said vertical plate-like member at the end of said vertical plate-like member opposite said first rolled portion, said second opening being substantially the same size as said first opening, and said first rolled portion of each step member means is positioned parallel to and is horizontally spaced from said second rolled portion of the step member means adjacent thereto; and a plurality of fastening means fitted through said first and second openings in said step member means and fitted into said holes in said stringers for fastening said step member means to said stringers, whereby a stairway is formed.

2. A stairway structure comprising:

two parallel stringers spaced from each other, said stringers having a plurality of regularly-spaced holes therethrough;

a plurality of adjacent step member means for providing a stairway surface fitted between stringers and having openings therethrough aligned with said regularly-spaced holes in said stringers, each step member means comprised of:

a vertical plate-like member having a plurality of first rolled portions in a spaced relationship across one end thereof, said first rolled portions forming a plurality of aligned first openings across the end of said vertical plate-like member, a first horizontal plate-like member having a plurality of second rolled portions in a spaced relationship across one end thereof, said second rolled portions forming a plurality of aligned second openings across one end of said horizontal plate-like member, said plurality of first and second openings being substantially the same size, and said plurality of first rolled portions are aligned with and positioned between said spaced plurality of second rolled portions of the step member means adjacent thereto; and a plurality of fastening means fitted through said aligned openings in said aligned first and second rolled portions and fitted into said holes in said stringers for fastening said step member means to said stringers, whereby a stairway is formed.

3. A stairway structure comprising:

two parallel stringers spaced from each other, said stringers having a plurality of regularly-spaced holes therethrough;

a plurality of adjacent step member means for providing a stairway surface fitted between said stringers and having openings therethrough aligned with said regularly-spaced holes in said stringers, each step member means comprised of:

a vertical plate-like member having a first rolled portion across one end thereof, said rolled portion forming a first opening therethrough, a first horizontal plate-like member having a second rolled portion at one end thereof, said second rolled portion forming a second opening therethrough, said horizontal plate-like member being integrally formed with said vertical plate-like member at the end of said vertical plate-like member opposite said first rolled portion, said second opening being substantially the same size as said first opening, each vertical plate-like member being, at the upper portion thereof opposite the end integrally formed with said horizontal plate-like member, bent at an angle corresponding to the angle formed by said horizontal plate-like member, whereby a second horizontal surface containing said first rolled portion is formed parallel to said horizontal plate-like member, and said first rolled portion of each step member means formed at the end of each second horizontal surface is positioned parallel to and is horizontally spaced from the second rolled portion of the step member means adjacent thereto; and a plurality of fastening means fitted through said first and second openings in said step member means and fitted into said holes in said stringers for fastening said step member means to said stringers, whereby a stairway is formed.

4. A stairway structure comprising:

two parallel stringers spaced from each other, said stringers having a plurality of regularly-spaced holes therethrough;

a plurality of adjacent step member means for providing a stairway surface fitted between said stringers and having openings therethrough aligned with said regularly-spaced holes in said stringers, each stairway means comprised of:

a vertical plate-like member having a first rolled portion across one end thereof, said rolled portion forming a first opening therethrough, a first horizontal plate-like member having a second rolled portion at one end thereof, said second rolled portion forming a second opening therethrough, said horizontal plate-like member being integrally formed with said vertical plate-like member at the end of said vertical plate-like member opposite said first rolled portion, said second opening being substantially the same size as said first opening, and said first rolled portion of each step member means is positioned parallel to and is vertically spaced from said second rolled portion of the step member means adjacent thereto; and a plurality of fastening means fitted through said first and second openings in said step member means and fitted into said holes in said stringers for fastening said step member means to said stringers, whereby a stairway is formed.

5. A stairway structure as claimed in claim 4, wherein each vertical plate-like member is substantially shorter in length than the length of each horizontal plate-like member.

6. A stairway structure as claimed in claim 1 wherein each step member means is comprised of three different layers of material including:

an innermost metallic material, and upper and lower layers of synthetic resin material against the upper and lower surfaces of said metallic material.

7. A stairway structure as claimed in claim 6 further comprising stumbling preventing means on said upper layer of synthetic resin material for preventing stumbling on said step member means.

8. A stairway structure as claimed in claim 7 wherein said stumbling preventing means is comprised of a plurality of elevated strips running lengthwise across said upper layer of said horizontal plate-like member at the end portion thereof adjacent said second rolled portion.

9. A stairway structure as claimed in claim 7 wherein said stumbling preventing means is comprised of a plurality of rounded projections raised above the surface of said upper layer across the end of said horizontal plate-like member at the end portion thereof adjacent said second rolled portion.

10. A stairway structure as claimed in claim 7 wherein said stumbling preventing means is comprised of wear-resistant granular material in said upper synthetic resin layer.

11. A stairway structure as claimed in claim 1 wherein each first rolled portion and each second rolled portion has at least one cut-out therein, whereby said first and second rolled portions can be welded to said fastening means passing therethrough at said cut-out portions.

* * * * *